US005257868A

United States Patent [19]

Ikehata et al.

[11] Patent Number: 5,257,868

[45] Date of Patent: Nov. 2, 1993

[54] PRINTER HEAD FOR PRINTER

[75] Inventors: Tsutomu Ikehata, Sakado; Yukihisa Kato, Higashikurume; Makoto Yasunaga, Kawagoe, all of Japan

[73] Assignee: Citizen Watch Co., Ltd., Tokyo, Japan

[21] Appl. No.: 810,606

[22] Filed: Dec. 19, 1991

[30] Foreign Application Priority Data

Dec. 21, 1990 [JP] Japan ..... 2-412635

[51] Int. Cl.[5] ..... B41J 2/27

[52] U.S. Cl. ..... 400/124; 101/93.05

[58] Field of Search ..... 400/124; 101/93.05

[56] References Cited

U.S. PATENT DOCUMENTS

| | | | |
|---|---|---|---|
| 4,728,205 | 3/1988 | Hasumi et al. | 400/124 |
| 4,895,464 | 1/1990 | Rubinshtein | 400/124 |
| 4,988,223 | 1/1991 | Hilkenmeier et al. | 400/124 |
| 5,054,942 | 10/1991 | Bernardis et al. | 400/124 |
| 5,083,876 | 1/1992 | Mitsuishi et al. | 400/124 |

FOREIGN PATENT DOCUMENTS

| | | | |
|---|---|---|---|
| 0200845 | 8/1986 | Japan | 400/124 |

*Primary Examiner*—Edgar S. Burr
*Assistant Examiner*—John S. Hilten
*Attorney, Agent, or Firm*—Lowe, Price, LeBlanc & Becker

[57] ABSTRACT

In a printing head for a printer, forward end surfaces of respective outer and inner peripheral walls of a solenoid base and forward end faces of a plurality of respective core sections arranged between the inner and outer peripheral walls along a peripheral direction are formed coextensive with each other. Outer-peripheral-wall abutment surfaces and inner-peripheral-wall abutment surfaces of armatures having respective sections disposed to be drawn opposite to the core sections are formed to be coextensive with each other. Core-section opposed surfaces of the sections to be drawn are formed coextensive with the outer-peripheral-wall abutment surfaces and the inner-peripheral-wall abutment surfaces. In another aspect of the invention, the core-section opposed surfaces are so formed as to be depressed toward a side opposite to the core sections.

2 Claims, 2 Drawing Sheets

PRINTER HEAD FOR PRINTER

BACKGROUND OF THE INVENTION

1. Field of the Invention

The present invention relates to a printing head for a printer.

2. Background of the Prior Art

A printing head is known which comprises a solenoid base having a plurality of drive units in which a plurality of solenoids are fitted respectively in outer peripheries of a plurality of respective core sections, and a plurality of armatures supported on a forward end face of the outer peripheral wall of the solenoid base and having drawing sections arranged in opposed relation to the forward end faces of the respective core sections, wherein, when any one of the drive units is energized, the armature corresponding to the drive unit is drawn to execute printing. As disclosed in Japanese Patent Laid-Open No. 135759/1986, when the armatures are moved angularly, the printing head has an inner peripheral wall which is abutted against the swinging ends, to limit or regulate the angular-movement stroke. Alternatively, as disclosed in Japanese Utility Model Laid-Open No. 56462/1988, the printing head has no such inner peripheral wall.

The former has the following problem. That is, an amount of gap defined by a step between the forward end faces of the outer peripheral wall and the inner peripheral wall of the solenoid base and the forward end faces of the core sections and a step between the outer-peripheral-wall abutment face and the inner-peripheral-wall opposed face of the armature and the core-section opposed surfaces of the sections to be drawn must be controlled or managed adequately. However, it is difficult to manufacture these steps with high accuracy. This causes high cost.

Further, the latter has the that, a spacer must be arranged at the forward end face of each of the core sections. The spacers are assembled onto all of the plurality of core sections, respectively. Thus, the number of parts and the number of assembling steps increase, so that the cost increases.

SUMMARY OF THE INVENTION

It is an object of the invention to provide a printing head for a printer, in which processing of a plurality of solenoids and a plurality of armatures can be facilitated, assembling of parts can be easy and a cost can be reduced, and the size of a gap defined between forward end faces of the respective core sections and core-section opposed surfaces of respective sections to be drawn can easily be brought to an adequate one.

It 'is another object of the invention to provide a printing head for a printer, in which forward end faces of respective outer peripheral wall, core sections and inner peripheral wall of a solenoid base are formed coextensive with each other, so that flatness of each of these forward end faces can be finished highly accurately by plain grinding or polishing or the like and at low cost.

It is still another object of the invention to provide a printing head for a printer, in which an outer-peripheral-wall abutment surface and an inner-peripheral-wall opposed surface of each of a plurality of armatures are formed coextensive with each other so that flatness of these both surfaces can be finished highly accurately and at a low cost by press or the like, in which a fulcrum of angular movement of each of the armature is substantially coextensive with an impinging surface so that, even in the case where the armatures impinge against the inner peripheral wall of the solenoid base, the armatures are difficult to be moved parallel, and in which the head is superior in abrasion proof or antifriction.

It is still another object of the invention to provide a printing head for a printer, in which it is possible to secure, easily and at high accuracy without an increase in number of parts, an amount of gap which is defined between core-section opposed surfaces of a plurality of sections to be drawn and a forward end face of a core section under a condition that a plurality of armatures are abutted against an inner peripheral wall and which exerts a great influence upon performance of the printing head.

It is further object of the invention to provide a printing head for a printer, in which outer-peripheral-wall abutment faces of respective armatures, core-section opposed surfaces thereof, and inner-peripheral-wall opposed surfaces thereof are formed coextensive with each other, in which a guard plate is mounted on a forward end face of the inner peripheral wall so that finish processing of the armatures is made further simply, in which an amount of gap defined between core-section opposed surfaces of a plurality of sections to be drawn and forward end faces of respective core sections of a solenoid base is decided or determined only by a wall thickness of the guard plate, and in which the amount of gap can be secured further simply and at high accuracy.

According to the invention, there is provided a printing head for a printer, comprising a solenoid base having an outer peripheral wall, an inner peripheral wall and a plurality of core sections arranged between the inner and outer peripheral walls along a peripheral direction, and a plurality of armatures arranged correspondingly respectively to the core sections, the armatures having a plurality of sections to be drawn opposed respectively to forward end faces of the core sections, respective outer-peripheral-wall abutment surfaces supported by a forward end face of the outer peripheral wall and inner-peripheral-wall opposed surfaces capable of being abutted against the inner peripheral wall, wherein the solenoid base is formed such that respective forward end faces of the outer peripheral wall, the core sections and the inner peripheral wall are coextensive with each other, wherein the outer-peripheral-wall abutment surfaces and the inner-peripheral-wall opposed surfaces of the respective armatures are formed coextensive with each other, and wherein the sections to be drawn are so formed as to be coextensive with the outer-peripheral-wall abutment surfaces and the inner-peripheral-wall opposed surfaces, or are so formed as to be depressed toward a side opposite to the core sections of the solenoid base.

DETAILED DESCRIPTION OF THE PREFERRED EMBODIMENTS

Figure 1:
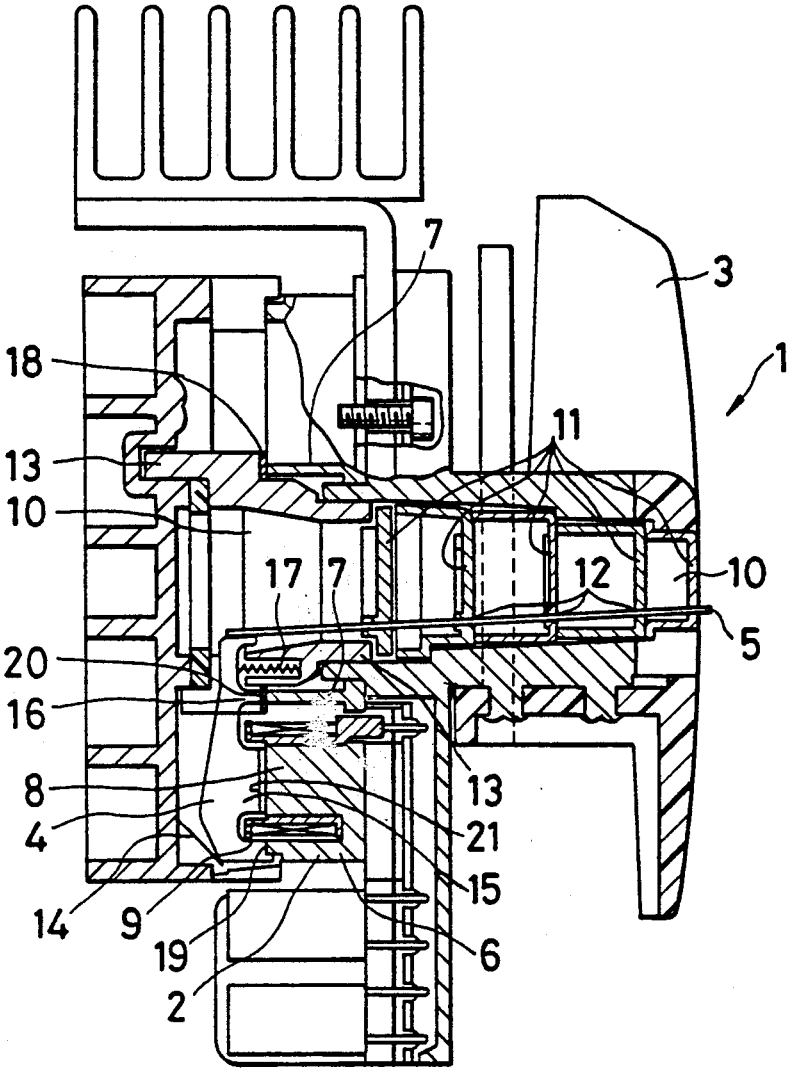
FIG. 1 is a longitudinal cross-sectional view of a printing head for a printer.
Figure 2:
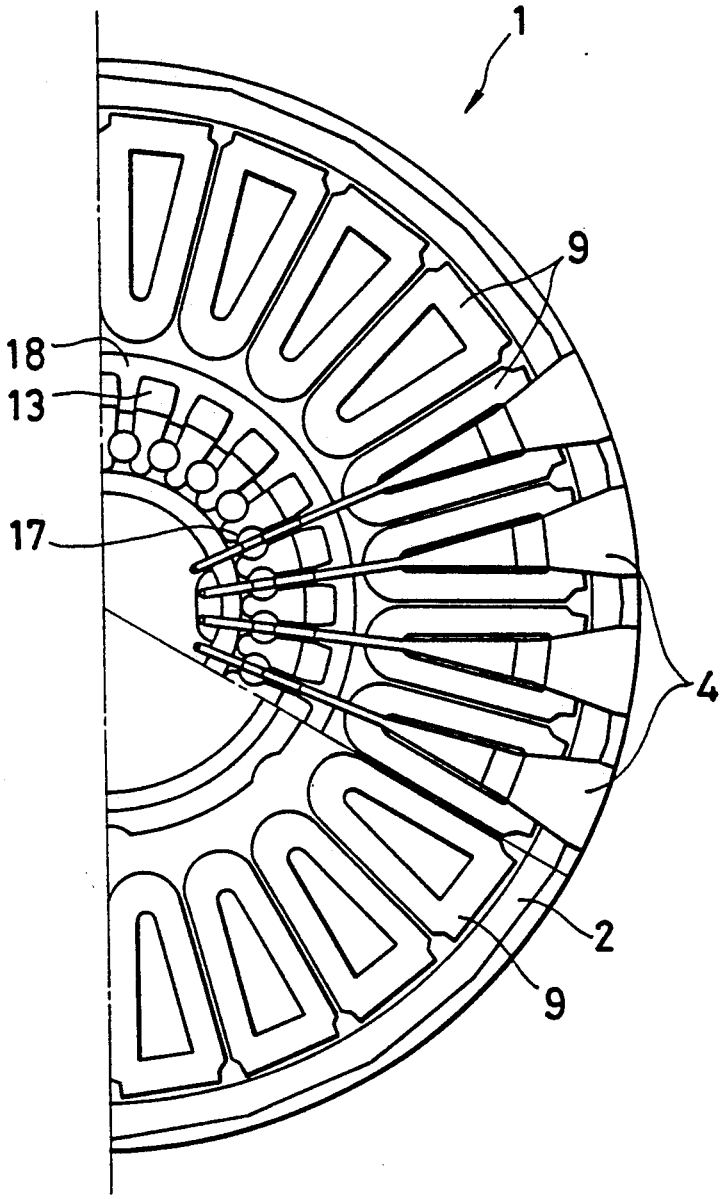
FIG. 2 is a fragmentary traverse cross-sectional view showing the printing head for the printer.

Referring first to FIG. 1, there is shown a printing head 1 for a printer, which comprises a solenoid body extending from a base 2 to an end face 50, a nose section 3, a plurality of armatures 4 and a plurality of needles 5.

The solenoid base 2 is generally in the form of a torus, and has an outer peripheral wall 6, an inner peripheral wall 7, a plurality of columnar core sections 8 arranged between the outer and inner peripheral walls 6 and 7 along a peripheral direction at suitable spacing, and a plurality of solenoids 9 fitted in the circumferences of the core sections 8. A needle receiving cavity 10 is defined at a center of the solenoid base 2. Forward end surfaces of the respective outer peripheral wall 6, inner peripheral wall 7 and core sections 8 are formed coextensive with each other.

The nose section 3 has a needle receiving cavity 10' extending through the nose section 3 along a center axis thereof. A plurality of needle guides 11 are arranged within the needle receiving cavity 10' along a longitudinal diretion thereof in a superimposed manner. The needle guides 11 are formed therein with a plurality of respective needle inserting bores 12.

The solenoid base 2 and the nose section 3 are arranged such that the needle receiving cavities 10 and 10' are located on the same axis or coaxially with each other. A plurality of needles 5 are arranged within the needle receiving cavities 10 and 10' so as to be slidable through respective needle inserting bores 12.

Furthermore, the armatures 4 are arranged radially at respective locations corresponding respectively to the columnar core sections 8, on a surface of the solenoid base 2 opposite to the nose section 3. The armatures 4 have respective outer ends thereof which are abutted against the solenoid base 2 by respective leaf springs 14, so that inner ends of the respective armatures 4 are supported for angular movement with the abutting portions serving as fulcrums. The inner ends of the respective armatures 4 are bonded respectively to deep ends of the needles 5.

A plurality of inner-peripheral-wall opposed pieces 16 extend or project respectively from inner ends of the respective armatures 4 adjacent to the solenoid base 2. Outer-peripheral-wall abutment surfaces 19, core-section opposed surfaces 21 of sections 15 of the respective armatures 4 to be drawn to corresponding core sections 8, and inner-peripheral-wall opposed surfaces 20 of the respective inner-peripheral-wall opposed pieces 16 are formed coextensive with each other.

An intermediate member 13 is fitted in a forward end face of the inner peripheral wall 7 of the solenoid base 2 through a guard plate 18 which is in the form of a ring. A plurality of return springs 17 for biasing respectively the armatures 4 in a direction opposite to the nose section 3 are received respectively at locations of the intermediate member 13 corresponding respectively to the armatures 4. Furthermore, the guard plate 18 is interposed between the inner peripheral wall 7 and the inner-peripheral-wall opposed surfaces 20 of the respective armatures 4. By the thickness of the guard plate 18, a gap or space is secured between oppositely disposed end faces of the columnar core sections 8 and the core-section opposed surfaces 21 at drawing or attracting.

Operation of the printing head 1 will next be described. When the solenoids 9 mounted on the solenoid base 2 are deenergized, the armatures 4 are brased to move away from nose section 3 by biasing forces of the respective return springs 17. The needles 5 are respectively engaged with the armatures 4 and are therefore retracted into the nose section 3.

When any one of the solenoids 9 is energized, the oppositely disposed plunger-shaped section 15 of the corresponding armature 4 is attracted to move against the biasing force of the return spring 17. The corresponding needle 5 engaged with the armature 4 is then moved forwardly or advances within the needle receiving cavities 10 and 10', and projects from the nose section 3. Thus, a printing operation by that needle is executed.

In this printing operation, if the needles 5 do not press a sheet of paper, the inner-peripheral-wall opposed surfaces 20 of the respective armatures 4 are abutted against the guard plate 18 which is mounted on the forward end face of the inner peripheral wall 7. A space or gap of a size substantially equal to a product, in which a ratio between a length from the fulcrums of the armatures 4 to the inner-peripheral-wall opposed surface 20 and a length from the fulcrums to the core-section opposed surfaces 21 is multiplied by the thickness of the guard plate 18, is defined between the forward end faces of the core sections 8 of the solenoid base 2 and the core-section opposed surfaces 21 of the sections 15 to be drawn.

When magnetic attracting forces existed by the solenoids 9 disappear, the armatures 4 are moved apart from the solenoid base 2 by the elastic bias forces of the return springs 17, and perform their respective return strokes. The needles 5 engaged respectively with the armatures 4 are thus retracted into the nose section 3.

In an alternative embodiment of the invention, where the core-section opposed surfaces 21 of the sections 15 to be attracted of the armatures 4 are so formed as to be retracted from the outer-peripheral-wall abutment surfaces 19 and the inner-peripheral-wall opposed surfaces 20, the guard plate 18 may be omitted.

What is claimed is:

1. A printing head for a printer, comprising:

a solenoid body extending from a base to an end face, having an outer peripheral wall, an inner peripheral wall and a plurality of columnar core sections circumferentially arranged between said inner and outer peripheral walls along a peripheral direction;

a plurality of armatures arranged in respective correspondence with said core sections, said armatures each having a plunger-shaped section with a surface disposed directly opposite a forward end face of a corresponding columnar core section to be attracted thereto, each armature also having a respective outer-peripheral-wall abutment surface disposed to be supported by a forward end face of said outer peripheral wall and an inner-peripheral-wall opposed surface disposed to be abutted against said inner peripheral wall and means disposed between each of said armatures and said solenoid base to ensure that a gap is maintained between said surface of said plunger-shaped section of each of said armatures and said forward end face of a corresponding columnar core section, wherein said solenoid base is formed such that respective forward end faces of the outer peripheral wall, the core sections and the inner peripheral wall are coplanar with each other, wherein the outer-peripheral-wall abutment surfaces and the inner-peripheral-wall opposed surfaces of the respective armatures are formed to be coextensive with each other, wherein an end surface of the columnar core section is disposed to be indented with respect to said end face of the solenoid body and said plunger-shaped section of the armature is received into said solenoid body;

and wherein said armature sections are formed to be coextensive with corresponding outer-peripheral-wall abutment surfaces and inner-peripheral-wall opposed surfaces.

2. A printing head for a printer according to claim 1, wherein:

the respective sections of each armature have core-opposed surfaces opposed to a corresponding core, said core-opposed surfaces being formed to be coextensive with the corresponding outer-peripheral-wall abutment surface and said inner-peripheral-wall opposed surface, wherein said means for maintaining said gap comprises a guard plate abutted against the inner-peripheral-wall opposed surfaces of the respective armatures disposed opposite the inner-peripheral-wall is mounted on a forward end face of the inner-peripheral-wall of said solenoid base.

* * * * *